United States Patent [19]

Horodysky

[11] Patent Number: 4,600,520

[45] Date of Patent: Jul. 15, 1986

[54] BORATED ADDUCTS OF DIAMINES AND ALKOXIDES AS MULTIFUNCTIONAL LUBRICANT ADDITIVES AND COMPOSITIONS THEREOF

[75] Inventor: Andrew G. Horodysky, Cherry Hill, N.J.

[73] Assignee: Mobil Oil Corporation, New York, N.Y.

[21] Appl. No.: 566,069

[22] Filed: Dec. 27, 1983

[51] Int. Cl.[4] ..... C10M 1/36

[52] U.S. Cl. ..... 252/49.6; 252/32.7 E; 564/8; 564/9; 564/141; 564/215; 564/224; 260/413; 558/295

[58] Field of Search ..... 252/49.6, 32.7 E; 564/8, 9, 141, 215, 224; 260/404.5 PA, 462 R, 413 R

[56] References Cited

FOREIGN PATENT DOCUMENTS 0049017 7/1982 European Pat. Off. ..... 564/8

*Primary Examiner*—William R. Dixon, Jr.
*Assistant Examiner*—Cynthia A. Prezlock
*Attorney, Agent, or Firm*—Alexander J. McKillop; Michael G. Gilman; Howard M. Flournoy

[57] ABSTRACT

Borated adducts of alkyl diamines and alkoxides impart effective multifunctional friction reducing and high temperature stabilizing characteristics to compositions comprising hydrocarbyl lubricants and fuels.

24 Claims, No Drawings

BORATED ADDUCTS OF DIAMINES AND ALKOXIDES AS MULTIFUNCTIONAL LUBRICANT ADDITIVES AND COMPOSITIONS THEREOF

CROSS REFERENCE TO RELATED APPLICATIONS

This application is related to copending application Ser. No. 566,083, filed of even date herewith entitled Borated Hydrocarbyl MULTIFUNCTIONAL LUBRICANT ADDITIVES.

BACKGROUND OF THE INVENTION

Borated adducts of hydrocarbyl diamines with long chain hydrocarbylene alkoxides have been found to be highly effective multifunctional high temperature stabilizing and friction reducing additives for both hydrocarbyl lubricants and fuels. In addition, minor amounts of these borated amino-alcohols improve high temperature stability of lubricants, greases and other solid lubricants prepared therefrom and possess potential detergency/dispersancy properties when blended into hydrocarbyl lubricants and fuels.

Many amine reaction products have been widely used as petroleum product additives in fuel and lubricant applications. In many instances these amine reaction products have been used to provide dispersancy/detergency and/or antirust properties. Also, amines, amides and their borated adducts have found widespread use in various petroleum products.

U.S. Pat. No. 4,389,322 describes certain ethoxylated amides and borated adducts thereof as being effective friction reducing additives.

U.S. Pat. No. 4,382,006 describes ethoxylated amines and their borated derivatives as being effective friction modifying additives for various hydrocarbyl lubricants. U.S. Pat. No. 4,328,113 describes alkylamines, alkyldiamines and borated adducts of alkylamines and diamines as effective friction reducing additives when incorporated into lubricating oils. Thus, many boron containing compositions have proven useful in fuel and lubricant compositions. They often provide brake fluid stabilizing or special gasoline enhancing properties to such compositions.

U.S. Pat. No. 4,368,129 describes metal salts of partially borated partially phosphosulfurized polyols and hydroxyl-containing esters as effective multifunctional friction reducing antioxidant and copper strip passivating additives when used in lubricating media such as hydraulic oils, brake oils, power transmission oils and the like.

It has now been found that borated adducts of hydrocarbyl diamines and hydrocarbylene epoxyalkanes possess at minor concentrations significant effective friction reducing and high temperature stabilizing properties when incorporated into hydrocarbyl lubricants and fuels. They also are expected to be effective antirust agents.

SUMMARY OF THE INVENTION

In accordance with the invention there is provided unique novel additives and compositions thereof which are borated reaction products of diamines such as N-coco-1,3-propylenediamine and long chain alkoxides such as epoxyalkanes. These novel reaction products provide multifunctional high temperature stabilizing and friction reducing additives for lubricants and fuels.

DESCRIPTION OF SPECIFIC EMBODIMENTS

The borated adducts of hydrocarbyl diamines and hydrocarbylene alkoxides in accordance with the invention may be prepared as described below.

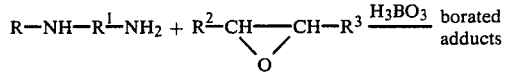

where

R is $C_8$–$C_{20}$ hydrocarbyl, preferably alkyl or hydrocarbyloxy $R^1$ is $C_2$–$C_4$ hydrocarbylene, preferably ethylene or propylene $R^2$ is $C_6$–$C_{20}$ hydrocarbyl $R^3$ is hydrogen or $C_1$–$C_6$ hydrocarbyl.

Useful hydrocarbyldiamines and hydrocarbyloxydiamines include for example N-tallow-1,3-propylenediamine; N-soya-1,3-propylenediamine; N-oleyl-1,2-ethylenediamine; N-tallow-1,2-ethylenediamine; N-soya-1,2-ethylenediamine; N-coco-1,2-ethylenediamine; N-triisodecyloxy-1,3-propylenediamine; N-coco-1,3-propylenediamine and N-oleyl-1,3-propylenediamine or mixtures thereof. Useful alkoxides or epoxyalkanes include 1,2-epoxypentadecane, 1,2-epoxyhexadecane; 1,2-epoxydodecane, 1,2-epoxydedacane, 1,2-epoxytetradecane, epoxidized isobutylenetrimer, epoxidized propylenetetramer and 1,2-epoxyoctadecane or mixtures thereof. Mixtures are, depending on such as the specific reactants and reaction conditions, on occasion preferred.

The borated derivatives described herein may be prepared by treating the reaction product of diamine and epoxyalkane with boric acid in the presence of an alcoholic or hydrocarbon solvent. The presence of a solvent is not essential. However, if one is used, it may be reactive or non-reactive. Suitable non-reactive solvents include benzene, toluene, xylene and the like. Suitable reactive solvents include isopropanol, butanol, the pentanols and the like. In general, reaction temperatures may vary from about 70° to about 250° C. with 80° to about 180° C. being preferred. Molar quantities of the amine and alkoxide are preferred, but ratios of 2:1 to about 1:2 can be used advantageously. Boronating species can include boric acid, low molecular weight trialkyl borates and other suitable boron carriers. Generally stoichiometric amounts of boric acid or other borating species are used. However, amounts in excess of this of up to about 100% stoichiometric excess can be used to obtain compounds of varying degrees of boration. Boration can therefore be complete or partial. Boration levels may vary in the instant compounds from about 0.05 to about 7 wt. %. The diamine products embodied herein, however, may be borated by any means known in the art. In general, the adduct of this invention possess greater friction reducing properties than similar non-borated derivatives. For example, as little as 0.02 wt. % up to about 1 to 2% wt. % of these additive compounds may reduce friction of a fully blended automotive engine oil as much as 39%. However, amounts up to 5–10% may be used if desired.

These products may be incorporated into the various lubricating media, for example, liquid hydrocarbon oils in the form of either a mineral oil or a synthetic oil, or in the form of a grease, in which any of the aforementioned oils are employed as a vehicle. These lubricants can also contain detergents and dispersants, as well as inhibitors, antiwear, extreme pressure, antifoam, pour depressant, and viscosity index improving additives without negating the beneficial properties of the novel additives/products of this invention.

In general, mineral oils employed as the lubricant or grease vehicle may be of any suitable lubricating viscosity range, for example, from about 45 SSU at 100° F. to about 6,000 SSU at 100° F., and preferably from about 50 SSU at 210° F. to about 250 SSU at 210° F. These oils may have viscosity indexes varying from below 0 to about 100 or higher. Viscosity indexes from about 70 to about 95 are preferred. The average molecular weight of these oils may range from about 250 to 800. Where the lubricant is to be employed in the form of a grease, the lubricating oil is generally employed in an amount sufficient to balance the total grease composition, after accounting for the desired quantity of the thickening agent, and other additive components to be included in the grease formulation.

In instances where synthetic oils are employed as the vehicle for the grease, in preference to mineral oils or in combination therewith, various compounds of this type may be successfully utilized. Typical synthetic vehicles include polyisobutylenes, polybutenes, hydrogenated polydecenes, polypropylene glycol, polyethlyene glycol, trimethylol propane esters, neopentyl and pentaerythritol esters, di(2-ethylhexyl)sebacate, di(2-ethylhexyl)adipate, di(butylphthalate) fluorocarbons, silicate esters, silanes, esters of phosphorus-containing acids, liquid ureas, ferrocene derivatives, hydrogenated mineral oils, chain-type polyphenols, siloxanes and silicones (polysiloxanes), alkyl-substituted diphenyl ethers typified by a butyl-substituted bis(p-phenoxy phenyl)ether, phenoxy phenylethers, etc.

The lubricating vehicles of the aforementioned greases of the present invention, containing the above described products, are combined with a grease forming quantity of a thickening agent. For this purpose, a wide variety of material may be employed. These thickening or gelling agents may include any of the conventional metal salts or soaps, which are dispersed in the lubricating vehicle in grease-forming quantities in such degree as to impart to the resulting grease composition the desired consistency. Other thickening agents that may be employed in the grease formulation may comprise the non-soap thickeners, such as surface modified clays and silicas, aryl ureas, calcium complexes and similar materials. In general, grease thickeners may be employed which do not melt and dissolve when used at the required temperature within the particular environment, however, in all other respects any materials which are normally employed for thickening or gelling hydrocarbon fluids for forming greases, can be used in preparing improved greases in accordance with the present invention.

Alkali and alkaline earth metal soaps of hydroxyl-containing fatty acids, glycerides and esters having from 12 to 30 carbon atoms per molecule are often preferred. The metals as typified by sodium, lithium, calcium and barium. Lithium is preferred. Thickeners containing a portion of above soap are also preferred.

Other additives which can also be used beneficially with the above invention include but are not limited to zinc dialkyl or diaryl dithiophosphates, metallic phenates and sulfonates and ashless dispersants. The metallic phenates and sulfonates are pfererably calcium or magnesium or overbased calcium or magnesium phenates or sulfonates. High temperature properties are often benefitted in the presence of 0.1–3 wt. % zinc dithiophosphates derived from low molecular alcohols such as isopropanols, butanols, pentanols, hexanols, decanols and the like.

The following example will specifically illustrate the invention. It will be understood that it is meant to be an exemplification and not a limitation of the invention.

EXAMPLE 1

BORATED REACTION PRODUCT OF N-OLEYL-1,3-PROPYLENEDIAMINE AND 1,2-EPOXYHEXADECANE

Approximately 720 g of N-oleyl-1,3-propylenediamine (commercially obrained as Duomeen O from Armak Chemical Co.), 150 g toluene and 480 g of 1,2-epoxyhexadecane (commercially obtained as a $C_{16}$alpha-olefin epoxide) were charged to a 3 liter reactor equipped with heater, agitator, and provision for blanketing the vapor space with nitrogen. The reaction mixture was heated to 120° C. for a period of 14 hours. The solvent was then removed by vacuum distillation to form the intermediate adduction product.

Approximately 120 g of the above adduction intermediate product was charged to a 1 liter reactor equipped with heater, agitator, Dean-Stark tube with condenser, and provision for blanketing the vapor space with nitrogen. Approximately 100 g toluene was added and the reactor contents were heated to about 60° C.; at this point 12 g boric acid were added. The reactor contents were heated to 160° C. over a period of 6 hours until water evolution during azeotropic distillation ceased. The solvent was removed by vacuum distillation at 160° C. The crude product was cooled to about 110° C. and filtered through diatomaceous earth. The product was a clear amber fluid which became waxy after cooling.

Example 1, in accordance with the invention, was blended into fully formulated synthetic and mineral oil based lubricants containing ashless dispersants, metallic phenates and sulfonates, zinc dithiophosphates and polymeric viscosity index improving additives. The formulations were then evaluated for friction reducing properties using the Low Velocity Friction Apparatus. As can be seen in Tables 1 and 2, the compositions reduced friction by up to 39%.

Example 1 was also blended into a solvent refined parafinnic neutral lubricating oil and tested for resistance to oxidation using the Catalytic Oxidation Test. The data therefrom is shown in Table 3. The composition of this application exhibited good control of acidity increase and good control of viscosity increase.

The products in accordance with the invention were evaluated in the below described manner.

LOW VELOCITY FRICTION APPARATUS (LVFA)

The Low Velocity Friction Apparatus (LVFA) is used to measure the coefficient of friction of test lubricants under various loads, temperatures, and sliding speeds. The LVFA consists of a flat SAE 1020 steel surface (diameter 1.5 in.) which is attached to a drive shaft and rotated over a stationary, raised, narrow ringed SAE 1020 steel surface (area 0.08 $in^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal the the coefficient of friction, is fed to the Y axis of an X—Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a 1/2 HP electric motor. To vary the sliding speed, the output speed of the transmission is regulated by a lever-cammotor arrangement.

Procedure

The rubbing surfaces and 12–13 ml of test lubricants are placed on the LVFA. A 240 psi load is applied and the sliding speed is maintained at 40 fpm at ambient temperature for a few minutes. A plot for coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction in friction compared to the unmodified oil. That is, the formulation mentioned above was tested without an additive compound of this invention and this became the basis for comparison. The results were obtained at 250° F. and 500 psi, and 40 fpm sliding speed. Freshly polished steel specimens are used for each run. The surface of the steel is parallel ground to 4 to 8 microinches. The percentages by weight are percentages by weight of the total lubricating oil composition, including the usual additive package. The data are percent decrease in friction according to:

$$\frac{(U_k \text{ of oil alone}) - (U_k \text{ of Additive plus oil})}{(U_k \text{ of oil alone})} \times 100$$

Thus, the corresponding value for the oil alone would be zero for the form of the data used in Table 1 and Table 2 below.

TABLE 1

Frictional Properties Using the Low Viscosity Friction Apparatus

| | Additive Conc. Wt. % | Percent Reduction In Coefficient of Friction 5 Ft./Min. | 30 Ft./Min. |
|---|---|---|---|
| Base Oil A - Fully formulated synthetic automotive engine oil containing detergent/dispersant/inhibitor performance package SAE 5W-30 | — | 0 | 0 |
| Example 1 - Borated reaction product of N—oleyl-1,3-propylenediamine and 1,2-epoxyhexadecane | 2 | 39 | 29 |

TABLE 2

Friction Properties Using Low Viscosity Friction Apparatus

| | Additive Conc. Wt. % | Percent Reduction in Coefficient of Friction 5 Ft./Min. | 30 Ft./Min. |
|---|---|---|---|
| Base Oil B - Fully formulated mineral oil based automotive engine oil containing detergent/dispersant/inhibitor package - SAE 10W-40 | — | 0 | 0 |
| Example 1 - Borated Reaction product of N—oleyl-1,3-propylenediamine and 1,2-epoxyhexadecane | 2 | 22 | 15 |

Example 1 was also tested for antioxidant characteristics in the *B*-10 Catalytic Oxidation Test at 325° F. for 40 hours. Present in the composition comprising a 200 seconds paraffinic neutral oil in addition to the additive compound were metals commonly used as materials to construct engines namely:

(a) 15.6 sq. in of sand-blasted iron wire;
(b) 0.78 sq. in. of polished copper wire;
(c) 0.87 sq. in. of polished aluminum wire; and
(d) 0.107 sq. in. of polished lead surface.

The test results as noted hereinabove are reported below in Table 3.

TABLE 3

B-10 CATALYTIC OXIDATION TEST 325° F. FOR 40 HOURS

| | Conc. Wt. % | N.N. of Oxidized Oil | % Incr. Viscosity of Oxidized Oil When Measured at 100° F. |
|---|---|---|---|
| Base Oil C - 200 second solvent paraffinic neutral lubricating oil | — | 3.62 | 67 |
| Example 1 - Borated Reaction product of N—oleyl-1,3-propylenediamine and 1,2-epoxyhexadecane | 2 | 1.61 | 20 |
| | 1 | 1.67 | 13 |

It is clear that the use of borated adducts of hydrocarbyl diamines and hydrocarbylene alkoxides or epoxyalkanes when incorporated into premium quality lubricant greases and fuels improve the high temperature stabilizing, antiwear characteristics and fuel economy properties without adverse affect upon other key performance areas. These families of novel multifunctional additives are non-corrosive in nature since chloride, sulfur and other potentially active species are absent. Accordingly it is concluded that these borates also contribute to the anti-rust/anti-corrosion properties of fully formulated lubricants and fuels.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. A reaction product produced by (1) reacting a hyrocarbyl or hydrocarbyloxydiamine or mixtures thereof with an alkoxide or mixtures thereof in molar ratios of from about 2:1 to about 1:2 at temperatures of from about 70° to 250° C. followed by (2) borating the product of (1) with substantially stoichiometric amounts of a boron compound or up to a 100% excess of a boron compound selected from the group consisting essentially of boric acid, a trialkyl boron compound or an ester of a boric acid.

2. The reaction product of claim 1 wherein the hydrocarbyl diamine employed is selected from those having the following general formula $$R—NH—R^1—NH_2$$

where R is $C_8$–$C_{20}$ hydrocarbyl or hydrocarbyloxy and $R^1$ is $C_2$–$C_4$ hydrocarbylene.

3. The reaction product of claim 2 wherein R is alkyl or hydrocarbyloxy and $R^1$ is $C_2$ or $C_3$ hydrocarbylene.

4. The reaction product of claim 1 wherein the alkoxide is an epoxyalkane and has the following general formula

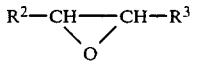

where $R^2$ is $C_6$–$C_{20}$ hydrocarbyl and $R^3$ is hydrogen or $C_1$–$C_6$ hydrocarbyl.

5. The reaction product of claim 2 wherein the diamine is selected from the group consisting of N-coco-1,3-propylenediamine; N-oleyl-1,3-propylenediamine; N-tallow-1,3-propylenediamine; N-soya-1,3-propylenediamie; N-oleyl-1,2-ethylenediamine; N-tallow-1,2-ethylenediamine; N-soya-1,2-ethylenediamine; N-coco-1,2-ethylenediamine or N-triisodecyloxy-1,3-propylenediamine and mixtures thereof.

6. The reaction product of claim 4 wherein the epoxyalkane is selected from the group consisting of 1,2-epoxypentadecane; 1,2-epoxyhexadecane; 1,2-epoxyheptadecane; 1,2-epoxyoctadecane; 1,2-epoxydodecane; 1,2-epoxytetradecane; epoxidized isobutylene-trimer; epoxidized propylenetetramer or 1,2-epoxyoctadecane and mixtures thereof.

7. The reaction product of claim 1 wherein said product is the borated reaction product of N-oleyl-1,3-propylenediamine and 1,2-epoxyhexadecane.

8. The reaction product of claim 1 wherein said product is the borated reaction product of N-coco-1,3-propylenediamine and 1,2-epoxyhexadecane.

9. A lubricant composition comprising a major proportion of a hydrocarbyl oil of lubricating viscosity or grease prepared therefrom, and an effective multifunctional and friction reducing amount of a product prepared by (1) reacting a hydrocarbyl diamine or mixtures thereof and an alkoxide or mixtures thereof at temperatures of from about 70° to 250° C. in molar ratios of from about 2:1 to about 1:2, and (2) reacting the intermediate product of (1) with a borating agent selected from the group consisting of boric acid, a trialkyl boron compound or an ester of a boric acid.

10. The composition of claim 9 wherein the hydrocarbyl diamine has the following general formula $$R—NH—R^1—NH_2$$

where R is $C_8$–$C_{20}$ hydrocarbyl and $R^1$ is $C_2$–$C_4$ hydrocarbylene.

11. The composition of claim 9 wherein said hydrocarbyl alkoxide is an epoxyalkane having the following general formula

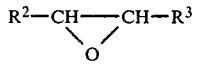

where $R^2$ is $C_8$–$C_{20}$ hydrocarbyl and $R^3$ is hydrogen or $C_2$–$C_8$ hydrocarbyl.

12. The composition of claim 9 wherein the product is the borated reaction product of N-coco-1,3-propylenediamine and 1,2-epoxyhexadecane.

13. The composition of claim 9 wherein the product is the borated reaction product of N-oleyl-1,3-propylenediamine and 1,2-epoxyhexadecane.

14. The composition of claim 11 comprising a product prepared from a mixture of said hydrocarbyl diamines and a mixture of said epoxyalkanes.

15. The composition of claim 9 comprising a lubricant selected from a suitable oil of lubricating viscosity.

16. The composition of claim 15 wherein the lubricating oil is a mineral oil.

17. The composition of claim 15 wherein the lubricating oil is a synthetic oil.

18. The composition of claim 15 wherein the lubricating oil is a mixture of mineral oil and synthetic oil.

19. The composition of claim 9 wherein the lubricant is a grease.

20. The composition of claim 19 wherein the grease is thickened by a thickener having at least by a minor proportion of lithium or calcium hydroxyl-containing carboxylate soap thickener therein.

21. The composition of claim 9 wherein said lubricant contains an additional component selected from the group consisting of metallic phenates or sulfonates, zinc dialkyl or diaryl dithiophosphates or esters, succinimide-type ashless dispersants or mixtures thereof.

22. The composition of claim 10 wherein the diamine is selected from the group consisting of N-coco-1,3-propylenediamine; N-oleyl-1,3-propylenediamine; N-tallow-1,3-propylenediamine, N-soya-1,3-propylenediamine, N-oleyl-1,3-propylenediamine, N-tallow-1,2-ethylenediamine; N-soya-1,2-ethylenediamine; N-coco-1,2-ethylenediamine or N-triisodecyloxy-1,3-propylenediamine and mixtures thereof.

23. The composition of claim 11 wherein the alkoxide or epoxyalkane is selected from the group consisting of 1,2-epoxypentadecane, 1,2-epoxyhexadecane; 1,2-epoxyheptadecane; 1,2-epoxyoctadecane; 1,2-epoxydodecane; 1,2-epoxytetradecane; epoxidized isobutylene-trimer; epoxidized propylenetetramer and epoxidized 1,2-epoxyoctadecane and mixtures thereof.

24. A method for reducing fuel consumption in an internal combustion engine comprising treating the moving surfaces thereof with a composition comprising a major amount of a hydrocarbyl oil of lubricating viscosity or grease prepared therefrom containing a minor effective multifunctional friction reducing or fuel reducing amount of a reaction product as described in claim 9.

* * * * *